United States Patent [19]

Alexander, III

[11] Patent Number: 4,593,725

[45] Date of Patent: Jun. 10, 1986

[54] CLOTH INSPECTION STAND FOR LOOM TAKEUP

[76] Inventor: William J. Alexander, III, P.O. Box 848, Mauldin, S.C. 29662

[21] Appl. No.: 560,983

[22] Filed: Dec. 13, 1983

[51] Int. Cl.[4] ..... D03D 49/20

[52] U.S. Cl. ..... 139/304; 139/311

[58] Field of Search ..... 139/304, 291 R, 309, 139/311; 26/70

[56] References Cited

U.S. PATENT DOCUMENTS

| | | | |
|---|---|---|---|
| 2,238,658 | 4/1941 | Pelcé et al. | 139/304 |
| 3,341,148 | 9/1967 | Cooper | 26/70 |
| 3,802,035 | 4/1974 | Estes | 26/70 |
| 3,865,151 | 2/1975 | Poole | 139/304 |
| 3,884,271 | 5/1975 | Bond et al. | 139/304 |
| 3,911,966 | 10/1975 | Bond et al. | 139/304 |
| 4,216,804 | 8/1980 | Alexander, III | 139/311 |
| 4,252,154 | 2/1981 | Alexander, III | 139/304 |
| 4,407,332 | 10/1983 | Alexander, III | 139/304 |

*Primary Examiner*—Henry S. Jaudon
*Assistant Examiner*—Jeseph S. Machuga
*Attorney, Agent, or Firm*—Bailey & Hardaway

[57] ABSTRACT

A cloth inspection stand is illustrated having a run of cloth on each side of the cloth takeup roll carried at an angle for ready inspection by one standing in the aisle on either side of the cloth roll takeup. The inspection stand makes provision for guiding a downward run of the cloth from the inspection area over a roll carried by pivoted arms for movement up and down to vary tension on the cloth.

5 Claims, 3 Drawing Figures

CLOTH INSPECTION STAND FOR LOOM TAKEUP

BACKGROUND OF THE INVENTION

A cloth inspection stand for use with a loom takeup is illusated in U.S. Pat. No. 4,216,804. Cloth inspection stands are provided for use in a variety of configurations including off the loom surface wind cloth roll takeups. Provision has been also made heretofore for guiding cloth downward through the ceiling from a loom located on the floor above for delivery to a suitable takeup. Such takeup devices affording an apparatus for inspecting the cloth preparatory to windup have made provision for inspecting only one side of the cloth. Where cloth, especially corduroy and the like, is being wound into a cloth roll, as in an arrangement where the cloth is fed from a loom on the floor above, lint and particulate waste adheres to the cloth and such is wound into the roll producing greasy or dirty spots on the cloth.

Accordingly, it is an important object of the present invention to provide a cloth inspection apparatus for use with an off the loom takeup wherein inspection may be had for quality and defects on both sides of the cloth from either side of the cloth roll respectively wherein the cloth may be viewed at an angle in each instance for better inspection.

Another important object of the invention is to provide greater accessability for inspection of the cloth from the aisle on each side of a cloth roll such that the cloth may be seen by a worker standing on the floor without the necessity of climbing up on a ladder or a platform, other than the usual weaver's platform, wherein the angular runs of cloth are positioned for inspection as conveniently low as possible in relation to the operator from either aisle.

Another important object of the invention is to provide an inspection stand wherein the cloth may be inspected from both sides of the cloth roll and wherein tension is controlled responsive to movement of a roll remote from the doffing area in an opposite aisle which is maintained clear of obstruction to facilitate doffing.

Still another important object of the invention is the provision of a cloth inspection stand providing a change of direction for the cloth in an aisle on each side of the cloth roll, such that lint and trash may be dislodged so as to fall from the cloth to prevent windup in the cloth roll.

SUMMARY OF THE INVENTION

It has been found that a cloth inspection stand may be provided, for use with an off the loom cloth takeup, having guide means for a first run of cloth for inspection on one side of a surface wound cloth roll with transport of the cloth across the cloth roll with guide means affording a second run of cloth for inspection on the other side of the cloth roll. Preferably, the first and second runs of cloth are inclined downwardly and rearwardly with respect to an observer in an aisle on opposite sides of the cloth roll to afford maximum accessability for inspection. The cloth passes for inspection over a roll carried in an aisle opposite the doffing area for controlling the tension on the cloth while maintaining the doffing area open and unobstructed. The cloth may be delivered to the inspection stand from a floor above and may be guided upwardly and forwardly over a roll carried on the doffing side of the cloth inspection stand in such a way that the roll may be pivoted outwardly out-of-the-way to accommodate doffing of the cloth roll.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an off loom surface wind cloth takeup having an alley on one side of the takeup for doffing a cloth roll and another alley on the other side of the takeup. A cloth inspection stand includes guide means including a roll A carrying a first run of cloth in open width for inspection by an operator standing in one of the alleys. Guide means which incorporates a transport roll B carries a second run of cloth in open width for inspection by an operator standing in the other of the alleys. The guide means include conveying means C transporting the cloth in open width from one of the alleys to the other of the alleys over the cloth roll. The cloth is illustrated as being fed through the floor in open width for takeup from a loom on a floor above. The first run of cloth passes downwardly at an angle toward the alley on one side of the takeup, whereas the second run of cloth passes downwardly at an angle toward the alley on the other side of the takeup. A substantially vertical run of cloth passes in open width downwardly on one side of the cloth roll from the first and second runs over a roll carried between free ends of pivoted arms D for movement up and down sensing the tension in the cloth preparatory to delivery to the cloth roll. The free ends of pivoted arms and the roll carried therebetween extend toward the other side of the takeup leaving the one side of the takeup clear for doffing.

Figure 1:
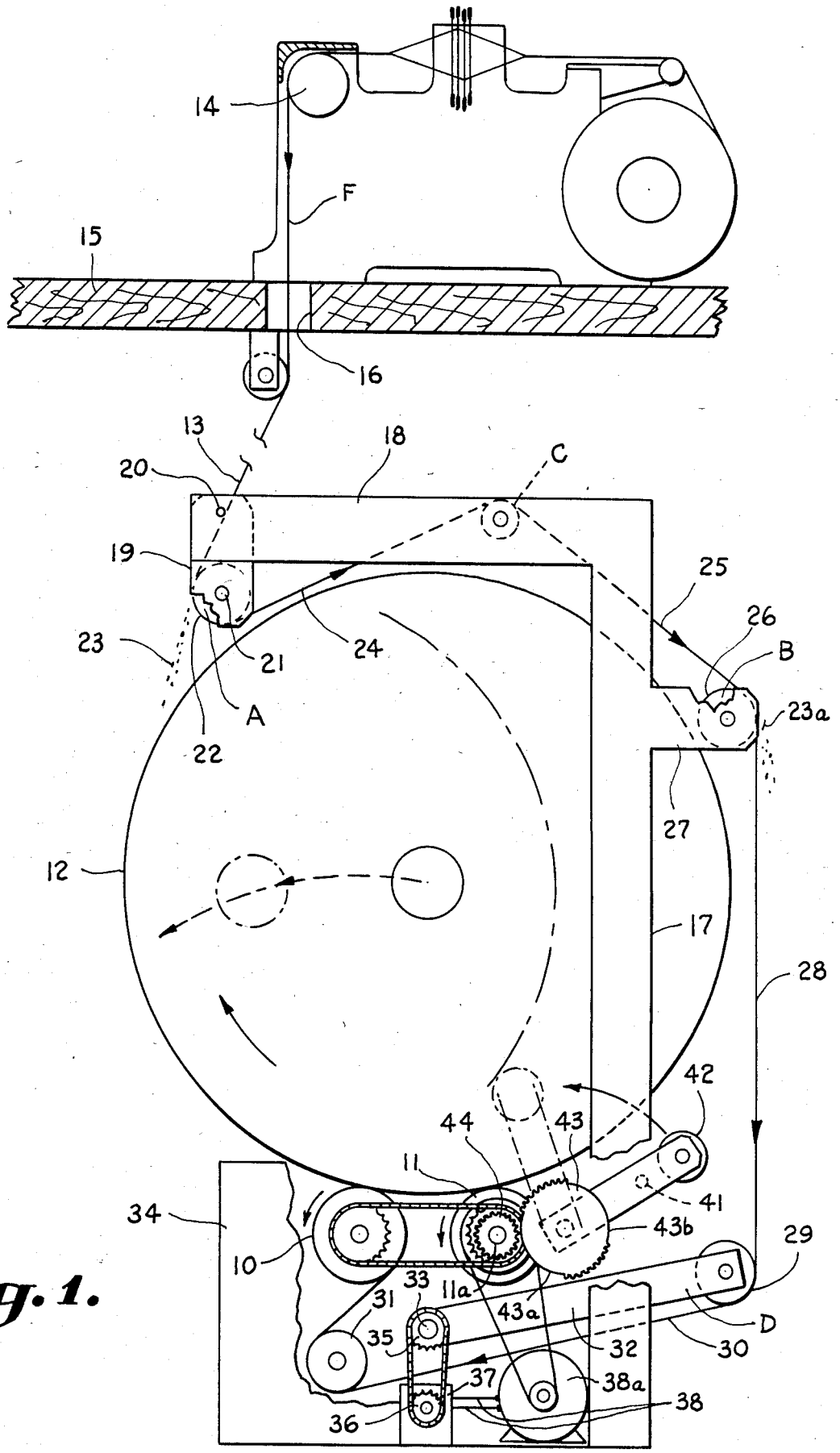
FIG. 1 is a schematic side elevation illustrating a cloth inspection stand for a surface wound off the loom takeup wherein the cloth is fed in a downwardly and forwardly moving run of cloth from a floor above.

FIG. 1 illustrates an off loom surface wind cloth takeup having a pair of driven rolls 10 and 11 driven in the direction indicated by the arrows for winding cloth on the cloth roll 12. The cloth is first delivered to the guide roll A in a downwardly and forwardly extending run 13 which passes from the sand roll 14 of a loom located on the floor 15 of a weave room above. The cloth F passes downwardly through a slot 16 in the floor and over a guide carried by the floor 15 to form the cloth run 13.

The cloth inspection stand includes a vertical frame 17 which carries a canterlevered portion 18 extending across the cloth roll substantially from one aisle to the other. At a free end of the canterlevered portion 18, a depending vertical support 19 is carried and is pivoted as at 20 on the canterlevered portion. The roll A has a shaft 21 which is journaled in the support 19.

Figure 2:
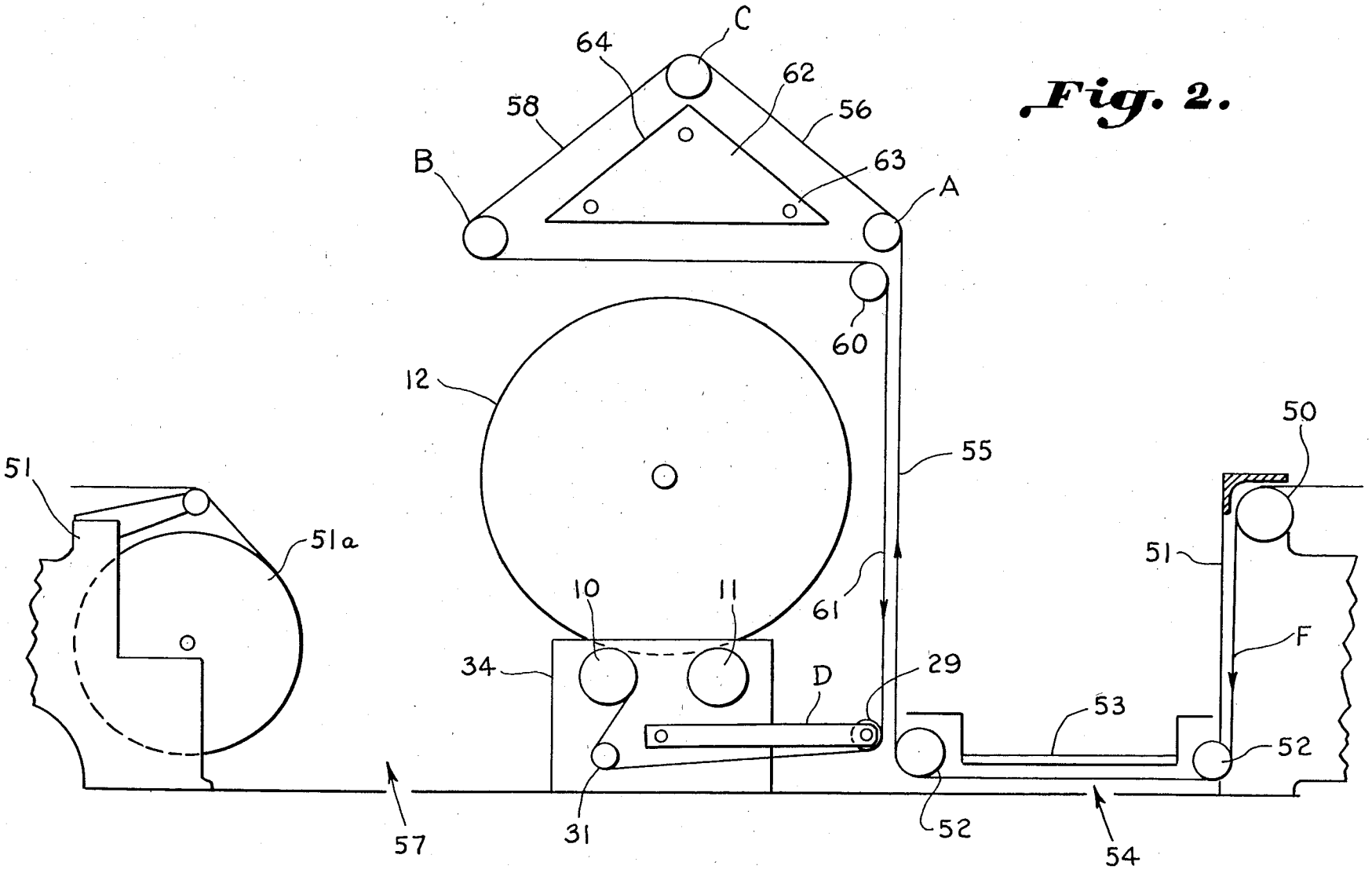
FIG. 2 is a schematic side elevation illustrating a modified form of the invention with parts omitted.

When the cloth roll 12 reaches a sufficient size and preparatory to doffing, the roll A and the support therefor extends downwardly below the cloth roll to provide maximum inspection area and accessability, the roll A and the support may be pivoted about the pivot point 20 to facilitate doffing, providing an unencumbered opening into the doffer's alley, such as best illustrated in FIG. 2. The roll A including the roll 22 which is carried by the shaft 21 affords a change of direction permitting trash and lint, as illustrated at 23, to fall out into the adjacent aisle on that side of the cloth roll.

A run of cloth is illustrated at 24 extending over the cloth roll 12 to the transport roll C of the conveying means which makes possible an angular second run of cloth 25 to facilitate inspection thereof from the weaver's aisle on the side of the loom opposite the first run of cloth 13. The second run of cloth extends forwardly and downwardly toward the weaver's aisle where it is received by the guide means B which includes the roll 26 carried by a suitable support 27 for providing a downwardly run of cloth 28 which disgorges lint and trash 23*a* due to change in direction of the cloth. The downward run of cloth extends to a compensator roll 29 which serves to control tension in the cloth and in addition, guide the cloth in a run 30 extending beneath the cloth roll to a guide roll 31 preparatory to passing over the support roll 10 for winding into the cloth roll.

The compensator roll 29 may be of the type illustrated in U.S. Pat. No. 4,216,804 and has a pair of arms 32 which are caried on a shaft 33 rotatably mounted within the housing 34. The shaft 33 carries a gear 35 for turning the input drive 36 to a variable transformer 37 which through leads 38 drives a suitable electric motor 38*a* for driving the support rolls 10 and 11.

A suitable doffing mechanism is illustrated which may be of the type shown in U.S. Pat. No. 4,203,563. Such a mechanism includes manually operated arms 40 which may be manipulated by the handle 41. Between suitable arms 40, a transverse roll 42 is provided for engagement with the cloth roll 12 for doffing same and moving in the direction of the arrow in FIG. 1. By manually raising the arms 40, a segmental gear 43 engages a gear 44 carried by the shaft 11*a* of the roll 11. The gear 43 has blank segments 43*a* and 43*b* for accommodating the teeth of the gear 44 when out of engagement preparatory to doffing and during the period following doffing respectively as more fully explained in the aforesaid patent, the disclosure of which is incorporated herein by reference.

FIG. 2 illustrates cloth F being fed from the sand roll 50 of the loom 51 beneath a pair of guide rolls 52 carried on either side of an operator's platform 53 located in the weaver's alley broadly designated at 54. The cloth F passes beneath the operator's platform and upwardly in a vertical run 55 passing over the guide means A and thence in a first run of cloth in an open width as illustrated at 56 for inspection preparatory to passage over the transport roll C and thence downwardly and outwardly toward the doffer's alley broadly designated at 57 in a second run 58. The cloth is received and its direction is changed by the guide roll B from whence the cloth passes in another run 59 over the cloth roll 12 to a guide roll 60 where the direction of the cloth is again changed to pass in a downward run 61 to the compensator roll 29 carried by the pivoted arms D. The doffer's alley 57 is thus open to receive the cloth roll which is doffed into the alley between the warp beam 51*a* of the next succeeding loom 51*b* and the housing 34 for the takeup.

A light box is illustrated schematically as at 62 in FIG. 2. The light box preferably has sides 63 and 64, respectively, for facilitating inspection of the first and second runs of cloth which pass thereover. The light box may be constructed as illustrated in U.S. patent application Ser. No. 454,697 filed Dec. 30, 1982, the disclosure of which is incorporated herein by reference.

Figure 3:
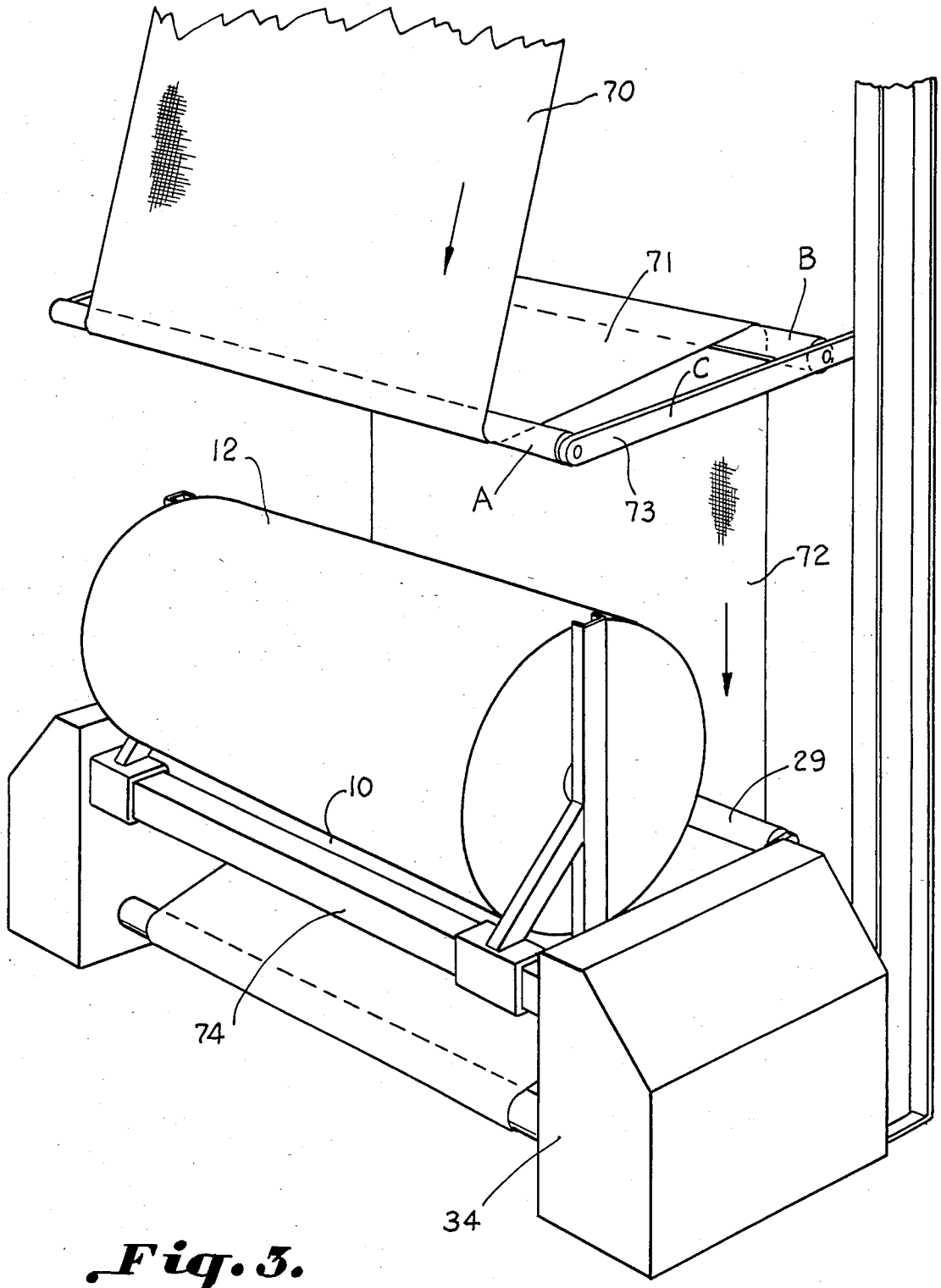
FIG. 3 is a perspective view illustrating a modified form of the invention wherein guide rolls perform the function of conveying means for transporting the cloth in open width from one alley to the other over the cloth roll.

FIG. 3 illustrates a modified form of the invention wherein a forward run of cloth 70 is received from a loom located on the floor above by a guide roll A for transporting it in open width in a run 71 to the roll B where the cloth again changes direction passing in a forward run 72 to the compensator roll 29 carried by the pivoted arms (not shown). The rolls A and B are carried by suitable support mechanism 73 which together with the run of cloth 71 perform the function of transporting the cloth over the cloth roll 10 carried within the takeup which is illustrated as having transverse frame members 74 connecting the end frame members 34. The support mechanism 73 and associated parts are designated as a transport means C.

In FIG. 1 the roll A together with a guide carried by the fllor 15 serves as guide means carrying the run 15. A run 55 in FIG. 2 is carried by guide means which includes the roll A and the roll 52. In FIG. 3 the guide means includes the roll A supporting the run 70. In FIG. 1 a second run 28 is carried by guide means including the roll B and the roll 29. Guide means in FIG. 2 includes the roll B and the transport roll C while in FIG. 3 the run 72 is supported by guide means including the roll B and the roll 29. Means transporting the cloth in a substantially horizontal run above and across the cloth roll includes rolls A and B in each instance. In FIGS. 1 and 2 the rolls C and in FIG. 3 the support mechanism 73 are also included in the means transporting the cloth.

In all of the embodiments of the invention illustrated, a first run of cloth passes in open width at a level above the takeup so as to be substantially at eye level for inspection by an operator standing in one of the alleys. A second run of cloth passes in open width at a level above the takeup for inspection substantially at eye level by an operator standing in the other of the alleys. It is also important that the cloth be transported as further illustrated in a substantially horizontal run in open width above, across and out of contact with the cloth roll. This gives the operator in both the first and second runs the opportunity to closely scrutinize the cloth from one edge or selvage to the other as is necessary to observe the defects sought to be located in the fabrics.

While a preferred embodiment of the invention has been described using specific terms, such description is for illustrative purposes only and it is to be understood that changes and variations may be made without departing from the spirit or scope of the following claims.

What is claimed is:

1. For use in an off loom surface wind cloth takeup having an alley on one side of the takeup for doffing a cloth roll from the takeup and another alley on the other side of the takeup, said alleys being accessible by operators standing in each of the respective alleys, a cloth inspection stand comprising:

guide means carrying a first run of cloth in open width at a level above the takeup for inspection by an operator standing in one of said alleys;

guide means carrying a second run of cloth in open width at a level above the takeup for inspection by an operator standing in the other of said alleys; and means transporting said cloth in a substantially horizontal run in open width from one of said alleys to the other of said alleys above across and out of contact with the cloth roll.

2. The structure set forth in claim 1 including a floor carrying looms above said takeup wherein said cloth is fed through the floor in open width for takeup from a loom, said first run of cloth passing downwardly at an angle toward said alley on one side of the takeup, and said second run of cloth passing downwardly at an angle toward said alley on the other side of the takeup.

3. The structure set forth in claim 1 wherein said cloth is fed beneath a weaver's platform in said alley on the other side of the takeup in open width for takeup, said first run of cloth passing over said cloth roll upwardly at an angle toward said alley on one side of the takeup, and said second run of cloth passing over said cloth roll from an intermediate point downwardly at an angle toward said alley on one side of the takeup.

4. The structure set forth in claim 3 including a light-box above the cloth roll intermediate thereof over which passes said first and second runs of cloth, and said cloth passing thence beneath said light box for delivery to the takeup roll.

5. The structure set forth in claim 1 wherein a substantially vertical run of cloth passes in open width downwardly on one side of said cloth roll from said first and second runs over a roll carried between free ends of pivoted arms for movement up and down sensing the tension in the cloth preparatory to delivery to the cloth roll, and said free ends of pivoted arms and said roll carried therebetween extending toward the other side of the takeup leaving said one side of the takeup clear for doffing.

* * * * *